US006111931A

United States Patent [19]

Kusch

[11] Patent Number: 6,111,931

[45] Date of Patent: Aug. 29, 2000

[54] X-RAY APPARATUS OPERABLE AT DIFFERENT ENERGY SUPPLY SOURCES WHICH RESPECTIVELY DELIVER DIFFERENT AVERAGE ELECTRICAL POWERS PER UNIT OF TIME

[75] Inventor: Jochen Kusch, Effeltrich, Germany

[73] Assignee: Siemens Aktiengesellschaft, Munich, Germany

[21] Appl. No.: 09/188,357

[22] Filed: Nov. 10, 1998

[30] Foreign Application Priority Data

Nov. 11, 1997 [DE] Germany ..... 197 49 944

[51] Int. Cl.[7] ..... H05G 1/60

[52] U.S. Cl. ..... 378/106; 378/101

[58] Field of Search ..... 378/101, 102, 378/103, 106, 114, 115, 116

[56] References Cited

U.S. PATENT DOCUMENTS 5,077,771 12/1991 Skillcorn et al. ..... 378/102
5,084,912 1/1992 Barr .

FOREIGN PATENT DOCUMENTS

AS 1 167 456 4/1964 Germany .
OS 2 3404 679 8/1974 Germany .
2 186 750 8/1987 United Kingdom .

OTHER PUBLICATIONS

"Impulstechnik beim Röntgrenkino," Boden et al., Röntgenfortschritte 98, vol. 5 (1963), pp. 631–635.

*Primary Examiner*—David P. Porta
*Attorney, Agent, or Firm*—Hill & Simpson

[57] ABSTRACT

An x-ray system which can be operated at various energy supply sources which can respectively deliver different average electric powers per unit of time, has an x-ray source supplied by a voltage generator, an x-ray receiver and a control unit to which the average electrical power to be drawn from the respective energy supply source can be prescribed. The control unit actuates the voltage generator so that, given the prescribed available average electrical power per unit of time, x-ray pulses can be generated with a period, an x-ray energy and a pulse repetition rate so that x-ray images of moving objects can be acquired in cine mode, with the average electrical power per unit of time drawn from the respective energy supply source not being exceeded, and with at least the x-ray energy or the pulse period or the pulse repetition rate of the x-ray pulse to be generated being prescribed.

14 Claims, 2 Drawing Sheets

X-RAY APPARATUS OPERABLE AT DIFFERENT ENERGY SUPPLY SOURCES WHICH RESPECTIVELY DELIVER DIFFERENT AVERAGE ELECTRICAL POWERS PER UNIT OF TIME

BACKGROUND OF THE INVENTION

1. Field of the Invention

The present invention relates to an x-ray system of the type having an x-ray source powered by a voltage generator and an x-ray receiver and a control arrangement for controlling the voltage generator to produce desired operating values for the x-ray source.

2. Description of the Prior Art

X-ray systems of the above type are used for registering x-ray images of stationary and moving objects. In medical applications, in order to be able to sharply display moving objects such as the heart or venous valves in x-ray images, the exposure time in the x-ray pickup—i.e. the pulse period of the x-ray pulse which is generated by means of the voltage generator and the x-ray source and which penetrates the moving object—could not be significantly longer than 10 milliseconds. Such exposure times pulse periods of x-ray pulses are achieved by large angio apparatuses such as that marketed by Siemens AG under the name "MULTISTAR," not only for single exposures of the moving object but also for cine exposures—i.e. a plurality of successive x-ray exposures in the cine mode.

The pulse technique in x-ray cinema is described by K. Boden and H. Schwesiger in "Röntgenfortschritte" 98 (1963), p. 631–635. It is explained therein that not only the pulse period but also the x-ray dose associated with the pulse are important for the achievement of equal blackening of single images in cine exposures. For the imaging of moving objects, however, the pulse period is decisive for the image sharpness of a single image or of a cine image.

German AS 11 67 456 discloses an x-ray diagnostic apparatus with a symmetrically grounded high-voltage circuit for x-ray cine exposure sequences with a grid-controlled x-ray tube and a circuit arrangement for influencing the control grid potential for controlling the x-ray tube from a blocked phase into a chronologically defined conductive phase. This apparatus demonstrates an improvement of the circuit arrangement for influencing the control grid potential of the x-ray tube.

German OS 23 04 679 teaches an x-ray diagnostic apparatus which is suitable not only for cine exposures with a film camera but also for making a single exposure with a single-image camera. To achieve this the x-ray diagnostic apparatus has an electronic image counter which is controlled by the cine camera and which triggers each x-ray exposure made by the film camera and the single-image camera for registering an x-ray image, simultaneously. The counter also actuates a unit for adjusting the dose rate of the x-ray tube to the different shutter speeds of the cine camera and the single-image camera following the end of the last image of a selectable number of film images of a cine sequence, and before the beginning of the subsequent image of the next sequence—i.e. during the period of the film transport of the film camera.

German OS 37 04 595 describes a pulsed x-ray apparatus having a circuit arrangement which effects a stabilization of the dose rate of the x-rays given voltage fluctuations of the x-ray source and which increases the effectiveness of the pulsed x-ray apparatus.

In addition, U.S. Pat. No. 5,084,912 teaches an angiography system for heart examinations which is modified such that it is also suitable for universal angiography. To this end the angiography system, for image acquisition in universal angiography, generates a number of closely successive x-ray pulses with a typical pulse period of 2 to 10 ms for heart examinations, with the single x-ray images generated by an x-ray image intensifier being accumulated by a TV camera. An image is thus acquired which corresponds to an image acquired with a single x-ray pulse with a period approximating the sum of the pulse periods of the individual x-ray pulses.

The cine mode of such x-ray systems requires the constant availability of a sufficient electrical energy to be able to generate x-ray pulses with sufficient period and x-ray energy as well as a pulse repetition rate, and thus a sufficient frame rate, for the cine mode. This requirement produces the disadvantage that such x-ray systems are usually constructed in stationary fashion, and can be connected only to certain energy supply sources, such as three-phase network terminals, which are able to make a sufficient average electrical power per unit of time constantly available for the cine mode of the x-ray diagnostic system.

SUMMARY OF THE INVENTION

It is an object of the present invention is to provide an x-ray system of the initially-described type wherein operation of the x-ray system in the cine mode is possible even given connection of the x-ray system to an energy supply source which can deliver only a limited average electrical power per unit of time compared, for example, to a three-phase network connection.

This object is inventively achieved in an x-ray system which can be operated at various energy supply sources which are respectively able to deliver different average electrical powers per unit of time. The inventive x-ray system has an x-ray source powered by a voltage generator, an x-ray receiver and a control unit to which the average electrical power drawable, per unit of time, from the respective energy supply source can be prescribed. This control unit actuates the voltage generator such that, given the prescribed available average electrical power per unit of time, x-ray pulses can be generated with a period, an x-ray energy and a pulse repetition rate to allow x-ray images of moving objects to be acquired in cine mode, which the average electrical power per unit of time drawn from the respective energy supply source not being exceeded, and with at least one of the x-ray energy, the period or the repetition rate of the x-ray pulse to be generated being prescribable to the control unit. The inventive x-ray system thus has a control unit which permits the adapted automatic controlling of the generation of x-ray pulses with respect to pulse period, x-ray energy and pulse repetition rate such that only a defined average electrical power per unit of time is drawn from a given energy supply source for the generation of the x-ray pulse. The maximum permissible average electrical power per unit of time drawn from an energy supply source for the generation of the x-ray pulse is prescribable to the control unit. The control unit thus enables the generation of x-ray pulses for the display of moving objects in cine mode nearly independent of the average electrical power deliverable by an energy supply source per unit of time, since the x-ray energy, the pulse period and particularly the pulse repetition rate can be automatically adjusted by the control unit to the currently available average electrical power of the energy supply source which is deliverable-per unit of time. For example, for the generation of certain x-ray pulses the x-ray energy and the pulse period can be prescribed to the control unit, and the control unit determines the pulse repetition rate of the x-ray pulse which can be achieved with given average electrical power available per unit of time. Given a prescribed average electrical power of the energy supply source and the x-ray energy of the x-ray pulse, for example, the pulse repetition rate varies depending on the desired pulse period. Thus with the aid of prescribed operating parameters of the x-ray device—e.g. the available power, the x-ray energy and the pulse period of the x-ray pulse—other operating parameters are determined—e.g. the pulse repetition rate—such that a cine mode of the x-ray device is possible, with the average electrical power per time unit drawable from an energy supply source not being exceeded.

Since the operation of the x-ray device is not linked to the presence of a defined energy supply source, the precondition is created for locationally independent use of the x-ray system. In an embodiment of the invention the x-ray system is carried on a mobile device carriage (cart). In the field of medicine, it is thus possible to perform radiological examinations of moving organs of a patient, for instance, independent of location, e.g. in operating rooms or even directly at a hospital bed.

In a particularly preferred embodiment of the invention the energy supply source is a conventional one-phase network terminal with a supply voltage of about 110 to 230 volts effective value and a supply peak current of about 10 to 16 amperes effective value. Such a network terminal is present in practically all rooms of a hospital or a medical clinic or a physician's office, for example, so that the x-ray system can be used in hospital rooms or medical examination rooms, completely independent of location.

In a further embodiment of the invention the prescribable average electrical power drawable from the energy supply source is approximately 1.5 to 2 kilowatts per second. Additional electrical components of the x-ray system thus can be supplied with energy during a radiological examination from the same energy supply source, namely from the conventional one-phase network terminal, for example, without overloading the energy supply source.

In another version of the invention the voltage generator can be connected to the energy supply source via capacitors which are constantly charged during the cine mode of the voltage generator, i.e., during the cine mode of the x-ray system. Such a connection of the x-ray generator to the energy supply source has the advantage that the voltage generator and thus the x-ray system are virtually always ready for operation—i.e. throughout the day—since no downtime results, such as charging time of a battery, given a connection of the voltage generator to a battery.

In further embodiments of the invention a CCD camera and/or a digital imaging system can be allocated to the x-ray receiver for digital image processing. The x-ray receiver is preferably an x-ray image intensifier having an output luminescent screen from which the CCD camera picks up acquired x-ray images which have been converted into optical images, and the CCD camera feeds these images to the digital imaging system for digital image processing. The utilization of a purely digital imaging system has the advantage that, according to further versions of the invention, a peak power of the x-ray generator of approximately 20 kilowatts is sufficient for the cine mode of the x-ray system, this allowing x-ray pulses of enough x-ray energy and with a period of approximately 5 to 10 milliseconds to be generated. The digital imaging system can specifically prepare and process an x-ray image which was generated with only 30% of the x-ray energy that would be required for an x-ray image processed with an analog imaging system.

DESCRIPTION OF THE PREFERRED EMBODIMENTS

Figure 1:
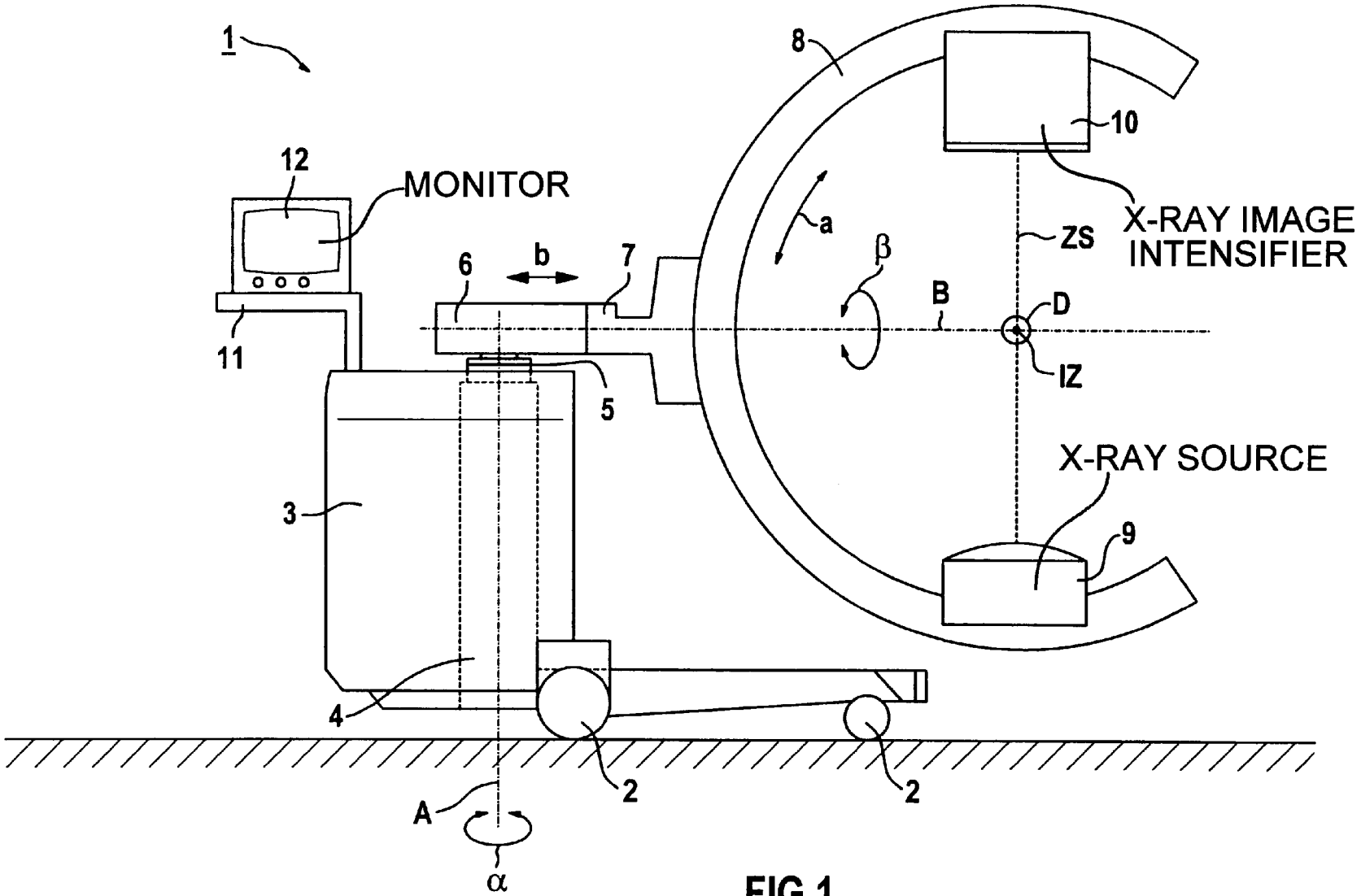
FIG. 1 is a side view of an inventive x-ray system in the form of a mobile x-ray C-arm apparatus.

FIG. 1 depicts an inventive x-ray device in the form of a C-arm x-ray apparatus 1 with a carriage or cart 3 that can be moved on wheels 2. The C-arm x-ray apparatus 1 includes a lifting mechanism 4—schematically indicated in FIG. 1—with a column 5 having a longitudinal axis A around which the column 5 is rotatable in the direction of the double arrow α. A holder 6 is arranged at the column 5, with a holding apparatus 7 for supporting a carrier fashioned as C-arm 8 being in turn arranged at the holder 6. The C-arm 8 carries an x-ray source 9 and an x-ray receiver in the form of an x-ray image intensifier 10 disposed opposite each other so that a center beam ZS of an x-ray bundle emitted by the x-ray source 9 strikes at the input luminescent screen of the x-ray image intensifier 10 approximately centrally.

The holding apparatus 7 is rotatable around an axis B which is common to the holder 6 and the holding apparatus 7 in known fashion (cf. double arrow β, angulation) and is mounted at the holder 6 so as to be displaceable in the direction of the axis B (cf. double arrow b). The C-arm 8 is mounted in the holding apparatus 7 so as to be displaceable along its circumference in the direction of the double arrow a (orbital motion), specifically in an angle range of about 190° (+/−95° out of its initial position shown in FIG. 1). The C-arm 8, which is connected to the column 5 of the lifting mechanism 4 via the holding apparatus 7 and the holder 6, is vertically displaceable relative to the carriage 3 by the lifting mechanism 4.

The displacement of the C-arm 8 in the holding apparatus 7 ensues isocentrically, i.e. the fulcrum D of the C-arm 8 lies in the beam path of the center beam ZS of the x-ray bundle emitted by the x-ray source 9. Once positioned in the isocenter IZ of the C-arm 8, an object thus always remains in the isocenter IZ given a displacement of the C-arm 8 in the holding apparatus 7 along its circumference relative to the object. Thus, given a displacement of the C-arm 8 along its circumference, a repositioning of the C-arm 8 relative to the object is unnecessary, since in such a case the image of the object which can be displayed on the screen of a monitor 12 arranged at a mount 11 of the x-ray apparatus does not wander undesirably across the screen of the monitor 12.

Figure 2:
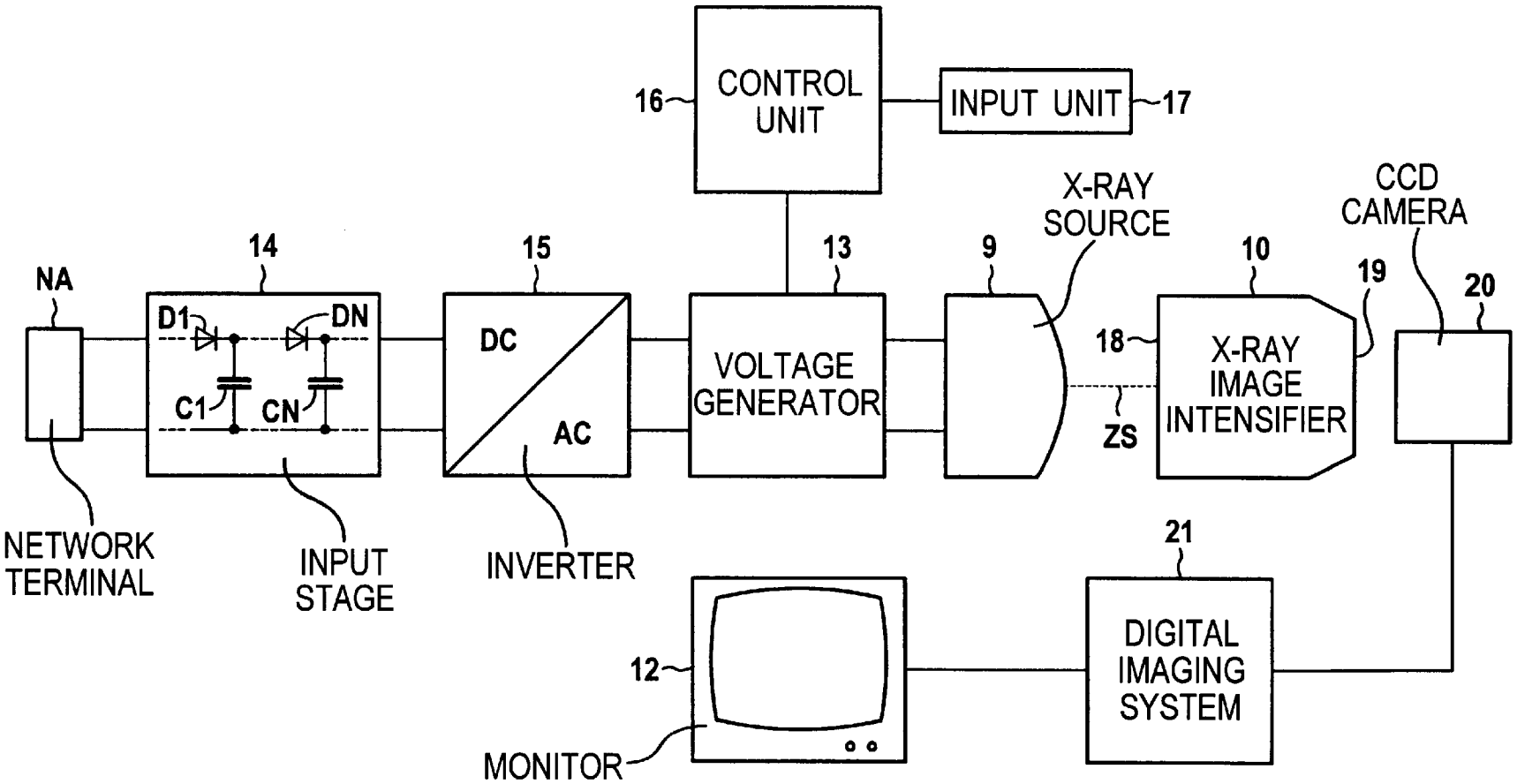
FIG. 2 is a block diagram showing components of the pickup of x-ray images in cine mode using the mobile C-arm x-ray apparatus of FIG. 1.

FIG. 2 schematically illustrates the basic components of the C-arm x-ray apparatus 1 for registering x-ray images in cine mode of a moving object (not shown).

A voltage generator 13, such as a high-frequency generator, supplies operating the voltages and currents to the x-ray source 9. The voltage generator 13 is connected to a single-phase network terminal NA via an input stage 14, containing capacitors C1 to CN and diodes D1 to DN for the generation of an intermediate circuit voltage, and an inverter 15 for the generation of a high-frequency alternating voltage. In the exemplary embodiment, the single-phase network terminal is a conventional single-phase network terminal with a supply voltage of 230 volts effective value and a supply peak current of approximately 16 amperes effective value. The C-arm x-ray apparatus 1 need not necessarily be connected to a network terminal NA which has voltage and current exactly at those values, but can alternatively be connected to any network terminal which delivers a supply voltage of 110 volts to 230 volts effective value and a supply peak current of about 10 to 16 amperes effective value, for example.

A control unit 16, which can be a computer, e.g. a PC, is allocated to the voltage generator 13. In the cine mode of the C-arm x-ray apparatus 1 the control unit 16 actuates the voltage generator 13 so that x-ray pulses are generated by the x-ray source 9 with a period and x-ray energy which enable a display of moving objects and with a repetition rate such that a prescribable average electric power per unit of time drawn from the single-phase network terminal is not exceeded. The average electrical power per unit of time can be set (selected) and entered into the control unit 16 by a person operating the C-arm x-ray apparatus 1 via an input unit 17 connected to the control unit 16, e.g. a keyboard. Not only the average electric power drawable from an energy supply source NA per unit of time, but also at least the x-ray energy, the pulse period or the pulse repetition rate of the x-ray pulses to be generated can be prescribed to the control unit 16. The x-ray energy required for defined x-ray exposures and the pulse period of the x-ray pulses are preferably prescribed to the control unit 16 as inputs via the input unit 17. The control unit 16 subsequently determines the possible pulse repetition rate of the x-ray pulses using the average electrical power per unit of time available from the energy supply source NA. The pulse repetition rate can also be additionally prescribed to the control unit 16. The control unit 16 then determines whether operation is possible using the prescribed values and communicates this to the user.

In the cine mode of the C-arm x-ray apparatus 1 the x-ray pulses emitted by the x-ray source 9—exemplified by the center beam ZS of an x-ray pulse is shown in FIGS. 1 and 2—permeate a moving object to be examined, such as the heart of a patient (not displayed in FIGS. 1 and 2) and strike the input luminescent screen 18 of the x-ray image intensifier 10. The x-ray images of the moving object, converted into optical images, are displayed on the output luminescent screen 19 of the x-ray image intensifier 10 and are subsequently registered by a CCD camera and are fed as digital signals to a digital imaging system 21, of a known arrangement and operation for further digital image processing of the x-ray images. The processed x-ray images can be subsequently displayed on the screen of the monitor 12 as individual images or in successive fashion, i.e. in the cine mode.

For proper operation of the digital imaging system 21 it is sufficient for the voltage generator 13 to deliver a peak power of approximately 20 kilowatts, this being adequate to generate x-ray pulses with sufficient x-ray energy and with a pulse period of about 5 to 10 milliseconds for the cine mode of the C-arm x-ray apparatus 1 for the display of moving organs of a patient, for example. The digital imaging system 21 can specifically prepare and process x-ray images which were generated with only 30% of the x-ray energy that would have been necessary for x-ray images processed with an analog system.

In the exemplary embodiment the average electrical energy drawn from the network terminal NA during the cine mode of the C-arm x-ray apparatus 1 has been prescribed at 1.5 kilowatts per second and thus lies in the preferred range of 1.5 to 2 kilowatts per second. It is thus guaranteed that during the cine mode of the C-arm x-ray apparatus 1 other electrically driven components of the C-arm x-ray apparatus 1, such as the monitor 12, can be operated at the network terminal NA without overloading the network terminal. The terminals of the other electrical components at the network terminal NA are not shown in FIGS. 1 and 2.

The possibility to prescribe the average electrical power per unit of time drawn from the network terminal NA during the cine mode of the C-arm x-ray apparatus 1 provides the advantage that the inventive C-arm x-ray apparatus 1 can be operated at different energy supply sources and thus can be used independent of location, and it is insured by means of the setting that an overlarge average electrical power per unit of time is not drawn from the energy supply source. In the exemplary embodiment, given a prescribed x-ray energy and pulse period of the x-ray pulse, the pulse repetition rate is adjusted by the control unit 16 such that the average electrical power of 1.5 kilowatts per unit of time is not exceeded in the generation of x-ray pulses. In the case of the exemplary embodiment, given a generator power of 20 kilowatts and a prescribed pulse period of 10 milliseconds, which corresponds to an energy draw of 200 W per x-ray pulse, a maximum image frequency of 7.5 x-ray images per second results given an average electrical power of 1.5 kilowatts per second, or an image frequency of 15 images per second given a prescribed pulse period of 5 milliseconds.

During the operation of the C-arm x-ray device 1, the capacitors C1 to CN of the input stage 14 are constantly charged by the voltage network from the network terminal NA, so that the voltage generator 3 can be operated in the cine mode practically without interruption not only for making a single exposure, but also for registering moving objects in cine mode. The connection of the voltage generator 13 to the network NA via capacitors C1 to CN thus offers the advantage that downtimes do not arise, as would be the case given a connection of the voltage generator 13 to a battery due to charging times of the battery.

In summary the prescription or setting of an average electrical power per unit of time to be drawn from an energy supply source allows the control unit 16 of the inventive C-arm x-ray apparatus 1 to actuate the voltage generator 13 so that x-ray pulses can be generated with a pulse period and an x-ray energy which enable a display of moving objects in cine mode and with a pulse repetition rate such that the prescribable average electrical power per unit of time to be drawn from the energy source is not exceeded.

The inventive x-ray system was described above using the example of a mobile C-arm x-ray apparatus 1. The inventive x-ray system, however, need not necessarily be a mobile C-arm x-ray apparatus, but can be constructed otherwise, for instance in stationary fashion and with a different carrying apparatus for the x-ray source and the x-ray receiver than a carrier in the shape of a C-arm.

Furthermore, a CCD camera need not necessarily be allocated to the x-ray receiver 10. Instead of the CCD camera other means for image registering of the x-ray images from the output luminescent screen of the x-ray image intensifier can be provided which enable a digitizing of the registered x-ray images.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray apparatus operable at a plurality of different energy supply sources which respectively deliver different average electrical powers per unit of time, said x-ray apparatus comprising:

an x-ray source which emits a pulsed x-ray beam composed of a plurality of x-ray pulses;

an x-ray receiver on which said x-ray pulses are incident;

a voltage generator adapted for connection to a plurality of different energy supply sources which respectively deliver different average electrical powers per unit of time, said voltage generator being connected to said x-ray source for supplying operating voltages to said x-ray source; and control means connected to said voltage generator for actuating said voltage generator dependent on the available average electric power per unit of time of an energy supply source currently connected to said voltage generator, for causing said x-ray source to emit x-ray pulses having a period, an x-ray energy and a repetition rate for obtaining x-ray images of moving objects in a cine mode without exceeding an average electrical power available from the energy supply source currently connected to said voltage generator; and means for prescribing at least said available average electric power per unit of time from a supply source currently connected to said voltage generator, and for prescribing at least one of said x-ray energy, said pulse period and said pulse repetition rate to said control means.

2. An x-ray apparatus as claimed in claim 1 further comprising a mobile carriage on which said x-ray source, said x-ray receiver, said voltage generator and said control unit are mounted.

3. An x-ray apparatus as claimed in claim 1 wherein said voltage generator is adapted for connection to an energy supply source comprising a one-phase network terminal with a supply voltage in a range between 110 and 230 volts effective value and a peak current in a range between 10 and 16 amperes effective value.

4. An x-ray apparatus as claimed in claim 3 wherein said means for prescribing said available average electric power per unit of time comprises means for prescribing an average electrical power per unit of time in range between 1.5 and 2 kilowatts per second.

5. An x-ray apparatus as claimed in claim 1 wherein said voltage generator has an input, and further comprising a plurality of capacitors in a capacitor bank connected to said input of said voltage generator and adapted for connection to an energy supply source.

6. An x-ray apparatus as claimed in claim 1 wherein said x-ray receiver generates an optical image, and further comprising a CCD camera allocated to said x-ray receiver for picking up said optical image.

7. An x-ray apparatus as claimed in claim 6 wherein said CCD camera emits a digital signal corresponding to said optical image, and further comprising said digital image processing means, supplied with said digital signal from said CCD camera, for processing said digital signal.

8. An x-ray apparatus as claimed in claim 1 wherein said voltage generator comprises a voltage generator which delivers a peak power of approximately 20 kilowatts.

9. An x-ray apparatus as claimed in claim 1 wherein said x-ray source, operated by said voltage generator and said control means, emits x-ray pulses having a period in a range between 5 and 10 milliseconds.

10. A method for operating an x-ray apparatus comprising:

providing a plurality of different energy supply sources which respectively deliver different average electrical powers per unit of time;

operating an x-ray source to emit x-ray pulses which strike an x-ray receiver to produce an x-ray image of a subject at said x-ray receiver;

supplying said x-ray source with voltages and current from a voltage generator to operate said x-ray source;

connecting said voltage generator to an energy supply source; and prescribing an available average electrical power per unit of time from said energy supply source and at least one of an x-ray energy, a pulse period and a pulse repetition rate of said x-ray pulses; and automatically controlling operation of said voltage generator, dependent on the prescribed available average electrical power per unit of time and the at least one prescribed x-ray energy, pulse period and pulse repetition rate, for producing x-ray images of a moving subject in a cine mode without exceeding said average electrical power per unit of time available from said energy supply source.

11. An x-ray device as claimed in claim 1 comprising connecting said voltage generator to a single-phase network terminal delivering a supply voltage in a range between 110 and 230 volts effective value and a peak current in a range between 10 and 16 amperes effective value.

12. A method as claimed in claim 10 comprising prescribing an available average electrical power per unit of time in a range between 1.5 to 2 kilowatts per second.

13. A method as claimed in claim 10 comprising supplying a peak power from said voltage generator to said x-ray source of approximately 20 kilowatts.

14. A method as claimed in claim 10 comprising emitting x-ray pulses from said x-ray source having a period in a range between 5 and 10 milliseconds.

* * * * *